United States Patent [19]

Fisher et al.

[11] Patent Number: 4,805,538

[45] Date of Patent: Feb. 21, 1989

[54] ELECTRIC TERMINAL TABLE

[75] Inventors: David W. Fisher; Lee N. Denny, both of Quakertown; Joseph T. Furlong, Perkasie, all of Pa.

[73] Assignee: JG Furniture Systems, Inc., Quakertown, Pa.

[21] Appl. No.: 504,303

[22] Filed: Jun. 14, 1983

[51] Int. Cl.[4] ..... A47B 9/04

[52] U.S. Cl. ..... 108/7; 108/10; 108/92; 108/147

[58] Field of Search ..... 108/4, 5, 7, 8, 9, 10, 108/92, 143, 144, 147

[56] References Cited

U.S. PATENT DOCUMENTS

| | | | |
|---|---|---|---|
| 885,748 | 4/1908 | Haggard | 108/147 X |
| 1,165,144 | 12/1915 | Tillotson | 108/7 |
| 1,417,096 | 5/1922 | Mueller | 108/7 X |
| 2,260,694 | 10/1941 | Self | 108/7 |
| 3,339,599 | 9/1967 | Dean, Jr. | 108/147 X |
| 3,778,125 | 12/1973 | Gutmann, Jr. et al. . | |
| 4,130,070 | 12/1978 | Herrin | 108/143 |
| 4,381,714 | 5/1983 | Henneberg et al. . | |
| 4,440,096 | 4/1984 | Rice et al. | 108/147 X |

FOREIGN PATENT DOCUMENTS

| | | | |
|---|---|---|---|
| 172616 | 6/1906 | Fed. Rep. of Germany | 108/7 |
| 347212 | 2/1905 | France | 108/7 |

OTHER PUBLICATIONS

Facit, "CRT Terminal Table with Pneumatic Height Control", brochure.
Data Furniture, RH System, advertisement.
Haskell, Inotec EDP 2100 brochure.
Watson, Flex Station brochure.
Systems Furniture Company, UFO-2000, advertisement.
IBM Syntergetix, Spring, 1981.
Wright Line, Ergonomic Terminal Work Stations advertisement.
*The Office, Magazine,* Jun. 1982, Hester S. Jones, "Designing Work Stations for the Information Age".
Prepared document entitled "Commercially Available Adjustable Terminal Tablets".
"Hamilton Sorter", Biotec Systems advertisement.

*Primary Examiner*—Peter R. Brown
*Attorney, Agent, or Firm*—Nixon & Vanderhye

[57] ABSTRACT

A table assembly supports a computer terminal and viewing screen, and keyboard, at a central location for optimum use by a number of users. Separate keyboard-supporting and terminal-supporting tables are independently vertically adjustable. Electrical switches on the keyboard-supporting table are actuated to effect operation of electric motors, which in turn rotate lead screws engaging nuts operatively attached to tubes supporting the tables, and thus effect reciprocation of the tables. The terminal-supporting table is pivoted about a horizontal axis so that the tilt thereof may be adjusted, and the keyboard-supporting table is slideable between detented positions to adjust the position of the keyboard with respect to the terminal and screen. At least one larger side panel, and a rear panel and other panels form the base of the assembly and allow it to be readily integrated with office furniture. Sufficient clearance is provided between all movable and stationary components so that the operator's fingers cannot be pinched.

15 Claims, 3 Drawing Sheets

Fig. 1
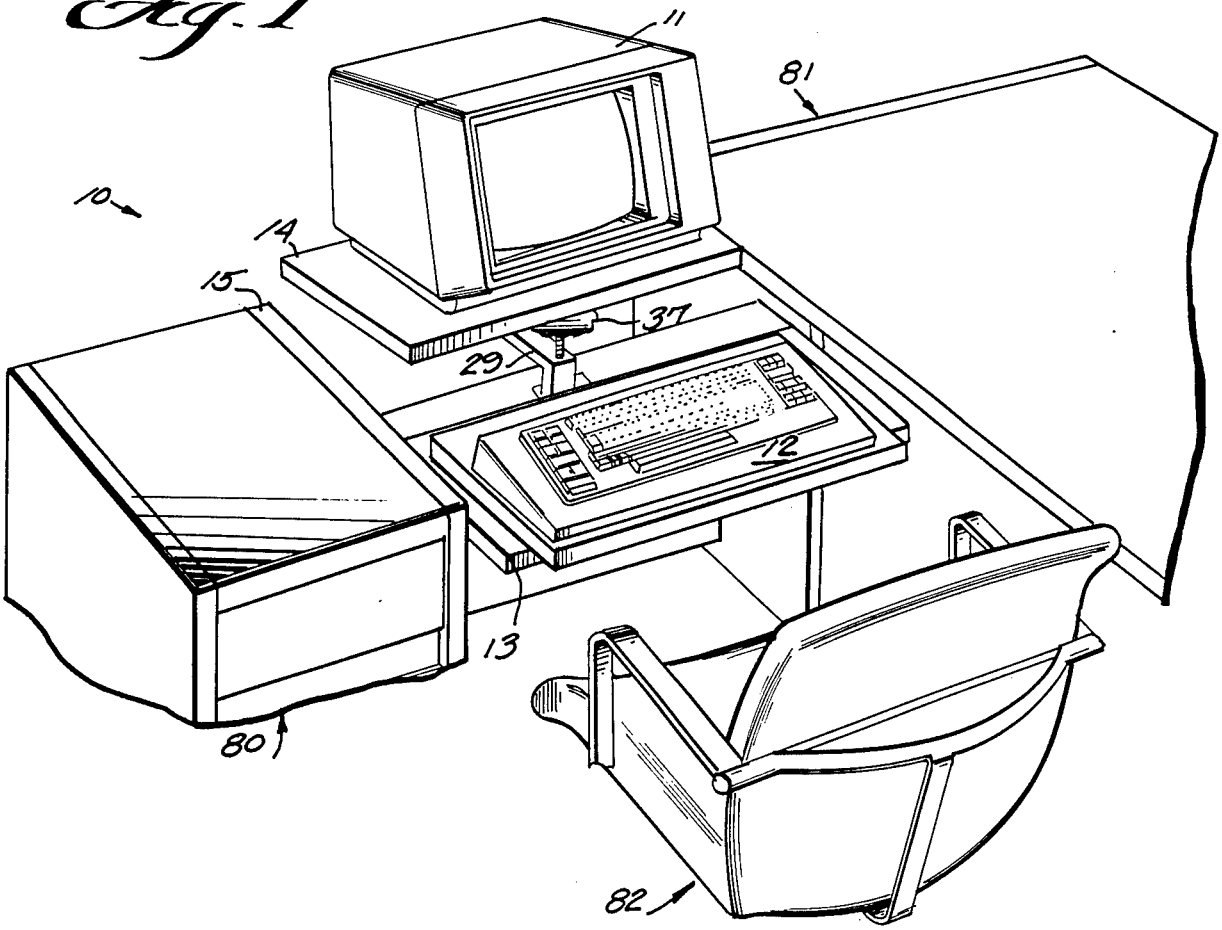
Fig. 3
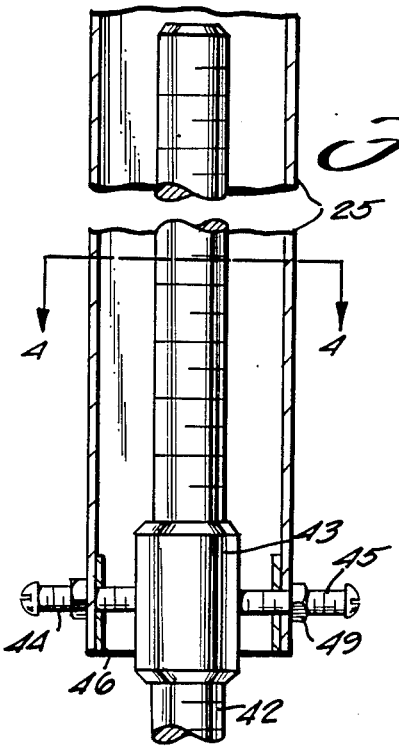
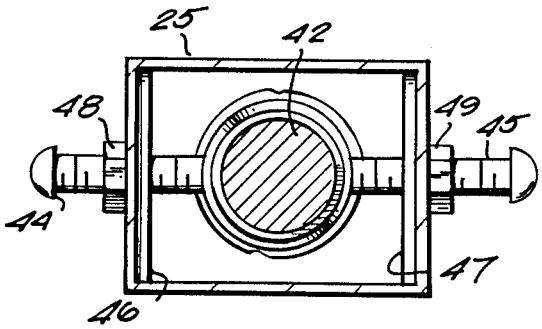
Fig. 4

ELECTRIC TERMINAL TABLE

BACKGROUND AND SUMMARY OF THE INVENTION

There are many situations in commercial or public establishments where computer terminals, or like equipment, are provided at a central location and are to be utilized by a number of different operators who come to the central location specifically for that use. In such situations, it is necessary to provide a mechanism for supporting the computer terminal viewing screen and the keyboard so that the appropriate adjustment thereof is easily effected.

Typical computer terminal support structures at central locations include first and second distinct tables, one for supporting the keyboard and the other for supporting the terminal viewing screen. An adjustment allowing the user to tilt the support surface for the screen to reduce glare is desirable. Also important are power mechanisms to adjust the screen height so that the user may view the screen without discomfort, and to adjust the keyboard height to permit proper positioning of the wrists and arms when inputting data via the keyboard. Ideally a mechanism to adjust the linear keyboard-screen distance to compensate for the eyesight of the user is also desirable.

According to the present invention, a table assembly, specifically adapted for supporting a computer terminal and keyboard, and like equipment, is provided which takes into account all of the above factors. The table assembly according to the invention accomplishes all of the above-noted desirable functions in a simple and efficient manner, and presents all of the components for effecting adjustment so that they are readily accessible by a user sitting down in front of the keyboard supporting table. The table assembly includes a base which allows ready positioning of the assembly in a desk system, or with other furniture groupings, so that it is readily assimilated in the grouping. Further, the mechanisms for adjusting the table heights are reliable lead screw mechanisms, and a single support post is provided for each table to maximize the simplicity of the equipment, and minimize possibilities of binding of the support as it is being raised and lowered, and maximize adaptability of the unit to various motor configurations and positions.

Tilt adjustment of the terminal-supporting table is provided in a simple and effective manner utilizing a large hand wheel attached to a screw-threaded rod, and positioned so that it is readily accessible from the front of the assembly, and spaced from the pivot axis of the table. Adjustment of the linear position of the keyboard-supporting table is provided by sliding rails on the table and support. The table is held in the position to which it is moved by a simple detent mechanism including a plunger located beneath the front of the keyboard-supporting table which is pulled downwardly to disengage it from the opening operatively provided in the bottom of the table, allowing adjustment of the position of the keyboard-supporting table, and then released to move into latching association with another opening associated with the bottom of the table. Motor controls (e.g. electrical switches) for controlling the motors for adjusting the vertical heights of the tables are also mounted on the keyboard-supporting table for easy operator access.

It is the primary object of the present invention to provide a simple, effective, and versatile table assembly for the convenient mounting of a computer terminal or the like. This and other objects of the invention will become clear from an inspection of the detailed description of the invention, and from the appended claims.

BRIEF DESCRIPTION OF THE DRAWINGS

FIG. 1 is a perspective view of a table assembly according to the present invention shown in operative association with other office furniture, and supporting a computer terminal and keyboard;

FIG. 3 is a vertical cross-sectional view of a portion of one of the support tubes of the table supports of the assembly of FIG. 2;

FIG. 4 is a cross-sectional view taken along lines 4—4 of FIG. 3;

DETAILED DESCRIPTION OF THE DRAWINGS

Figure 2:
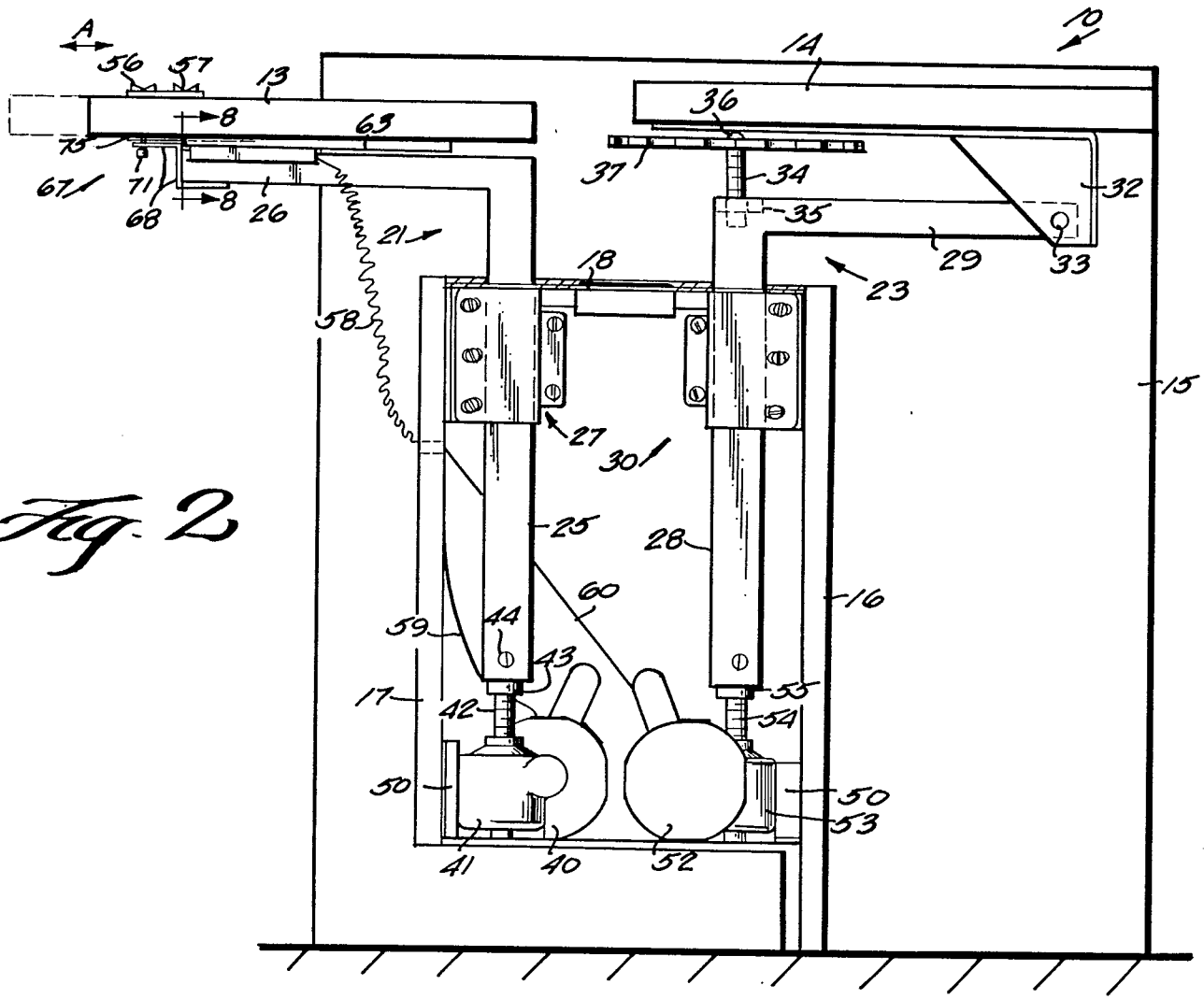
FIG. 2 is a side view of the table assembly of FIG. 1 with the near side panel removed for clarity of illustration.

An exemplary table assembly according to the present invention is shown generally by reference numeral 10 in FIGS. 1 and 2. The table assembly is adapted to support a computer terminal and viewing screen 11, and a keyboard 12 for inputting data to the terminal 11. The assembly 10 supports the terminal 11 and keyboard 12—or like equipment—so that there is adjustability of the components 11, 12 with respect to the user, and with respect to each other.

The assembly 10 includes a first table 13 and a second table 14. The first table 13 is dimensioned so that it may conveniently fit a keyboard 12 or the like thereon, and the second table 14 is dimensioned so that it can easily fit a computer terminal and viewing screen 11 thereon. The assembly 10 further comprises a base which, in the embodiment illustrated in FIGS. 1 and 2, includes as the main components thereof a first side panel 15 and a rear panel 16. As seen in FIG. 2, the panels 15, 16 both engage the ground to support the rest of the assembly 10, and preferably the panels 15, 16 are rigidly attached together so that they are perpendicular to each other.

The base also includes front panel 17, and top panel or panels 18. Another side panel is provided covering the volume defined by the panels 16 through 18, that side panel having been removed in the FIG. 2 illustration for clarity. Preferably the side panel opposite the panel 15 has a size and configuration identical to the panel 15, and is ground supported. However, if the panels 15, 16 provide sufficient ground support the other side panel need only be large enough to cover the volume defined by panels 16–18.

As seen in the embodiment illustrated in FIG. 2, the panel 15 has a much greater height than the panels 16 through 18. However as seen in FIG. 1, the length of the panels 16 through 18 is greater than the widths of the tables 13, 14. It is enough greater so that there is clearance provided between the tables 13, 14 and the side panel 15 (and the opposite side panel if one comparable to the panel 15 is utilized) so that a human adult may place his/her hand in the clearance area and the fingers it will not be pinched by the tables 13, 14 should relative movement between the tables and the human's hand occur while the hand is in the clearance (i.e. the is greater than the thickness of the fingers).

As also seen in FIGS. 1 and 2, clearance is provided between the tables 13, 14, and between the table 14 and the support (23) therefor so that, again, there is sufficient clearance to prevent pinching of an operator's fingers during relative movement between components.

Operatively connecting the tables 13, 14 to the base 15–18 are a first support structure 21 and a second support structure 23. The first support structure 21 supports the first table 13, and the second support structure 23 supports the second table 14, completely independently of the first table 13. According to the present invention the support structure 21 comprises a single vertically extending tube 25 which is quadrate in cross-section, and which has a horizontally extending arm 26 cantilevered therefrom. An adjustable guide bushing assembly 27 is mounted within the volume defined by the panels 16 through 18, preferably being mounted to the front panel 17, and stationary with respect to the front panel 17, allowing vertical, positively guided reciprocation of the support tube 25.

The second support structure 23 is substantially identical to the first support structure 21. It includes the single vertical quadrate-cross-section metal tube 28 with horizontally extending arm 29, and bushing 30, the bushing 30 being rigidly attached to the rear panel 16.

The second table 14 is mounted to the second support structure 23 so that it can tilt about a horizontal axis. This is desirable to position the computer terminal and viewing screen 11 so that glare is minimized. Adjustment is accomplished by mounting the table 14 by bracket 32 so that opposite arms of the bracket straddle the horizontal arm 29, and passing a pivot pin 33 through the arms of the bracket and the arm 29. The pivot pin 33 defines a horizontal axis (parallel to the front surfaces of the tables 13, 14) about which the second table 14 pivots.

Mounted to the support tube 28 in a position linearly spaced from the pivot pin 33 is the threaded rod 34. The exterior threads of the rod 34 engage interior threads of a nut, shown in dotted line by reference numeral 35 in FIG. 2, interiorly of the support tube 28. A rounded top tip 36 of the rod 34 engages the bottom of the second table 14, and rigidly attached to the rod 34 for effecting rotation thereof is the large hand wheel 37, which includes a leading portion thereof which extends horizontally outwardly in front of the second table 14.

An operator engaging the hand wheel 37 may effect rotation of the rod 34, and thus vertical reciprocation of the tip 36, to thereby pivot the table 14 about the pivot point 33. The table 14, and computer terminal 11 mounted thereon, have sufficient mass so that the table 14 always engages the tip 36. If desired, stops may be provided for limiting the vertical reciprocation of the tip 36 with respect to the arm 29 to prevent the terminal 11 from sliding off of the table 14, and for this purpose also a projection may be provided at the rear edge of the second table 14.

Vertical reciprocation of the tubes 25, 28 is accomplished utilizing power means which are actuated by an operator sitting in front of the first keyboard 13. The power means comprises, for the first support tube 25, a first electrical motor 40 connected through a gear box 41 or the like to a vertically extending lead screw (Acme Screw) 42. As seen in FIGS. 3 and 4, the lead screw 42 extends upwardly into the tube 25 and has cross-sectional dimensions substantially smaller than the interior cross-sectional dimensions of the tube 25. In order to translate rotational movement of the lead screw 42 about a vertical axis into vertical reciprocation of the tube 25, a travelling nut 43 is provided. The nut may be made of Delrin, or like material, and has interior threads which cooperate with the exterior threads of the lead screw 42.

The nut 43 is held so that it is stationary with respect to the support tube 25 by the fasteners 44, 45, which engage it from opposite ends of the tube 25. Preferably, the fasteners 44, 45 comprise screw threaded fasteners which are in threaded engagement with a side wall and attached plates 46, 47 of the support 25, so that the positions of the nut-engaging ends of the screws 44, 45 may be radially adjusted with respect to the tube 25. Once the screws 44, 45 have been moved to the appropriate position they may be held in place by tightening down nuts 48, 49.

By providing the adjustable fasteners 44, 45 and the large cross-sectional dimensions of the interior volume of the support 25 with respect to cross-sectional dimensions of the lead screw 42 and nut 43, allows adjustment of the positioning the nut 43 in support 25. This is important in insuring alignment of the lead screw 42 and the nut 43 so that there is no binding as the support tube 25 is reciprocated, or any excessive wear of the motor 40, screw 42, or nut 43. In order to further facilitate adjustment between the components to prevent binding or excessive wear, the motor 40 and gear box 41 preferably are also mounted by mounting screws extending through horizontally elongated slots formed in the bases 50 of the components 40, 41, by which components 40, 41 are connected to the rear or front panels 16, 17 (See FIG. 2). The motor 40 and gear box 41 are adjustable along the length of such slots (not shown, but which are elongated in a dimension perpendicular to the page in FIG. 2) and then held in place by tightening down screws extending through such slots.

Figure 5:
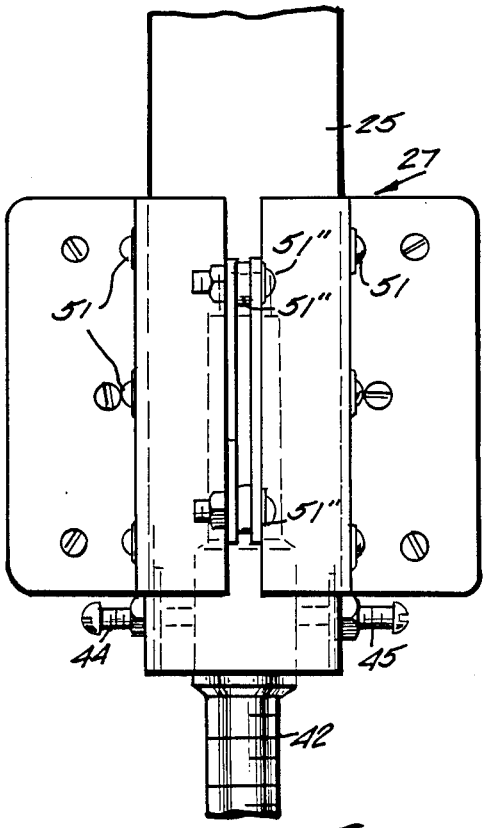
FIG. 5 is a front view of the structure of FIG. 3 in operative association with a guide bushing according to the invention.
Figure 6:
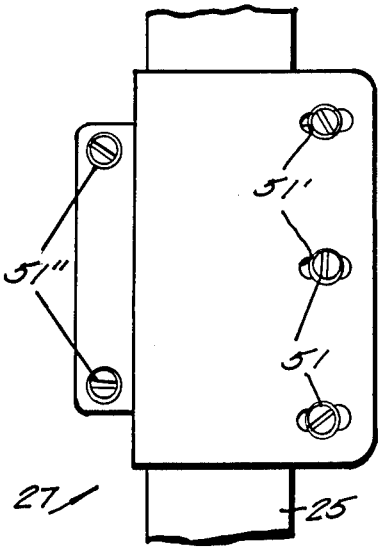
FIG. 6 is a side detail view of the bushing of FIG. 5.

The upward travel of the support tube 25 is positively limited by the screws 44, 45 engaging the bottom of adjustable guide bushing (bracket) 27, as seen in FIG. 5.

The guide bushing 27 also is part of a means for ensuring no binding of the tube 25 as it is reciprocated up and down. Screws 51 in elongated slots 51' provide for front to tack frame tension adjustment, while screws 51'' compress thick rubber washers 51''' a desired amount to provide side-to-side frame tension adjustment.

The second support tube 28 is reciprocated utilizing components substantially identical to the components illustrated in FIGS. 3–6 for the first support tube 25. For instance a second motor 52, second gear box 53, and second lead screw 54 with cooperating nut 55 are provided. Other components will not be described since they are substantially identical to those described with respect to FIGS. 3 and 4.

The motors 40, 52 are easily controlled by mounting a pair of electrical switches 56, 57 on the top surface of the first table 13, adjacent the front thereof. The switches 56, 57 may, for instance, be conventional rocker switches having three positions, "off", "up", and "down", and may be spring biased to the central "off" position. Switch 56 controls motor 40 and switch 57 controls motor 52, an electrical interconnection being provided between the switches and motors by the loose flexible coil 58 of insulated electrical wire. Coil 58 is mounted to the first table 13 for reciprocation therewith in dimension A (see FIG. 2), and passes through the front panel 17 of the base with wire 59 leading to motor 40 and wire 60 leading to motor 52.

Figure 7:
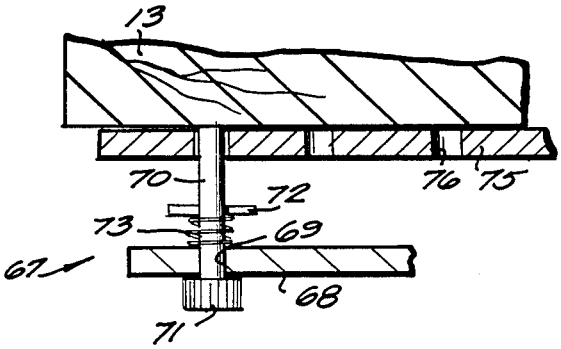
FIG. 7 is a side, partial, detail cross-sectional view of the detent mechanism for holding the keyboard-supporting table in the linear position it has been moved.
Figure 8:
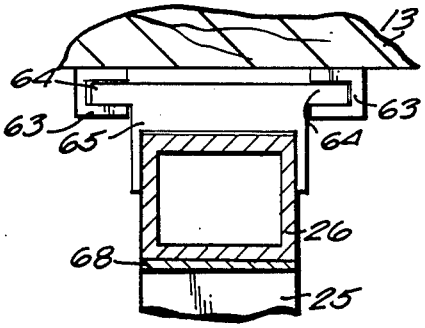
FIG. 8 is a detail view taken alone lines 8—8 of FIG. 2 showing the interengagement of relatively slideable components of the keyboard-supporting table.

The first table 13 is mounted to the support structure arm 26 so that it is vertically reciprocal in the dimension A from the position illustrated in solid line in FIG. 2, to at least the position illustrated in dotted line in FIG. 2. Any suitable means may be provided for effecting horizontal reciprocation of the table 13, and locking of the table in the position to which it has been moved. Once such suitable means is illustrated in FIGS. 2, 7, and 8.

Attached to a central portion of the bottom of the table are a pair of spaced metal channels 63 (see FIGS. 2 and 8), which straddle and engage the rail projections 64 from a cap 65 mounted on top of the arm 26. The cap rails 64 may be of a low friction material, or ball bearings or rollers may be provided for allowing easy sliding of the cap 65 in the channels 63, and thus reciprocation of the table 13 with respect to the arm 26. Alternatively, a slide assembly-such as shown in copending application Ser. No. 504,108, filed June 14, 1983, now abandoned may be utilized.

For maintaining the table 13 in the horizontal position to which it has been moved, the detent means generally illustrated by reference numeral 67, and shown in FIGS. 2 and 7, may be provided. The detent means 67 includes a bracket 68 mounted to the arm 26 and having horizontally extending portion (illustrated in FIG. 7) with a through-extending vertical opening 69 through which a plunger 70 passes. The plunger 70 includes a head 71 and a removable pin 72 passing horizontally therethrough. A coil spring 73, or the like, acts between the bracket 68 and the pin 72 to bias the plunger 70 upwardly. Mounted to the bottom of the first table 13 is a metal plate 75 which includes a number of openings 76 spaced along the length thereof in the dimension A, and disposed over the plunger 70 for registry therewith. When the plunger 70 is biased by spring 73 into an opening 76, as illustrated in FIG. 7, the table 13 is held in the horizontal position to which it has been moved.

In FIG. 2, the tables 13, 14 are illustrated in their lowest vertical positions. Such positions are at, or slightly below, the top of the side panel 15 for ease of transportation and installation of the assembly 10.

Operation

The assembly 10 is placed in a permanent position in a furniture grouping, with side panel 15 flush with, or integral with, another furniture component such as desk drawers 80 (see FIG. 1) or the like. Another furniture component, such as a complete desk 81, is mounted on the opposite side as the side panel 15, and may be integrally attached to the panels 16 through 18, or to a side panel of the assembly 10 base opposite panel 15.

With the tables 13, 14 initially in the position illustrated in FIG. 2, the operator sits down in the chair 82 (FIG. 1) in front of the keyboard 12 (mounted on table 13) and terminal and viewing screen 11 (mounted on table 14). The operator actuates switch 57 to power motor 53, which rotates lead screw 54, the rotation of the lead screw 54 being transformed into vertical reciprocation of the support tube 28 by the nut 55. The switch 57 is actuated until the terminal 11 is at the proper viewing height. Then the operator, still seated, moves his/her hand into engagement with the wheel 37, and imparts rotational movement thereto. By turning the wheel 37 counter-clockwise, the tip 36 moves upwardly and the table 14 pivots about pivot pin 33 so that the leading end thereof moves upwardly with respect to the trailing end thereof, until glare on the screen is minimized.

The operator then actuates switch 56 which turns on motor 40, which in turn rotates lead screw 42 and effects vertical reciprocation of support tube 25, rotation of screw 42 being transformed into vertical reciprocation of the tube 25 by the nut 43. When the keyboard 12 is at the proper height, the operator's hand is removed from switch 56 and it automatically returns to the "off" position.

If the operator's eyesight requires it, the operator then moves the keyboard 12 closer to him/her by pulling down on the plunger head 71 to move the plunger 70 out of an opening 76, grasping the table 13 along the side thereof to slide it forward, and then releasing the plunger head 71 and moving the table 13 a bit more until the plunger 70 is biased into another opening 76, latching the table 13 in that horizontal position.

During these operations, the operator will have no fear of his/her hands or fingers being pinched during relative movement between components because sufficient clearance is provided between the tables 13, 14 and the side panel 15, and desk 81 (or opposite side panel) to prevent pinching. Sufficient clearance is also provided between the trailing edge of table 13 and front edge of table 14, and between the wheel 37 and the support arm 29.

When the assembly 10 is originally being installed, the screws 44, 45 are adjusted to position the nut 43 with respect to the lead screw 42. The position of the lead screw 42 is adjusted by adjusting the positions of the motor 40 and gearbox 41. Further, the screws 51 and 51'' are adjusted to properly align the brackets 27, 30 with their respective support tubes 25, 28. These adjustments, in toto, insure that there is no binding during vertical reciprocation of the tubes 25, 28, and no excessive wear on components.

It will thus be seen that according to the present invention a simple, versatile, and effective table assembly has been provided, particularly adapted for use in supporting a computer terminal and viewing screen, and keyboard, to maximize convenient utilization thereof. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and assemblies.

What is claimed is:

1. A table assembly comprising:

a first table;

a second table;

a base;

a first support for interconnecting said base and said first table said first support comprising a tube that is quadrate in cross-section, and an adjustable bushing mounted to said base and for receipt of said tube for positively guiding it in reciprocation with respect to said base;

a second support, distinct from said first support, for connecting said second table to said base;

first power means, connected to said base, for adjusting the vertical position of said first table with respect to said base;

second power means, connected to said base, for adjusting the vertical position of said second table with respect to said base;

said power means comprising: a motor; a vertically extending lead screw operatively connected to said motor, said lead screw extending into the interior of said support tube; a nut disposed interiorly of said support tube and in screw-threaded engagement with said lead screw; and means for mounting said nut so that it is stationary with respect to said support tube;

adjustment means, associated with said second table and said second support, for providing adjustment of the angular orientation of said second table with respect to the horizontal; and wherein said first support comprises a single support post extending upwardly from said base and operatively interconnected to said first table; and wherein said second support comprises a single support post extending upwardly from said base and operatively connected to said second table.

2. An assembly as recited in claim 1 wherein said means for mounting said nut comprises: a pair of fasteners extending through opposite sides of said tube and into abutting engagement with said nut; and means for adjusting the positions of said fasteners with respect to said tube so that the position of said nut within said tube may be adjusted, said nut having exterior cross-sectional dimensions substantially less than the interior cross-sectional dimensions of said support tube.

3. An assembly as recited in claim 2 wherein said second support and second power means are substantially identical to said first support and first power means.

4. An assembly as recited in claim 2 further comprising means for mounting said motor for adjusting the position of said motor, and said lead screw, with respect to said base and support tube; said motor mounting means, adjustable bushing, and adjustable fasteners collectively comprising means for adjusting alignment between the components so as to prevent binding of said tube when reciprocated.

5. An assembly is recited in claim 1 wherein said second support includes a generally horizontally extending arm portion, and wherein said means for pivotally mounting said second table to said support pivotally mounts said second table to said horizontally extending arm portion of said support.

6. A table assembly comprising:

a first table;

a second table;

a base, said base comprising: a ground-supported first side panel having a predetermined height, width, and thickness, said height and width being significantly greater than said thickness; a front panel and a back panel, said front and back panels having heights substantially less than the heights of first said side panel, and rigidly connected thereto; a top panel extending between said front, rear, and side substantially greater than the width of said top panel, and the spacing between said front and rear panels; and a second side panel; at least one of said rear or second side panels being ground-supported;

additional supporting surfaces connected to the tops of said side panels;

wherein said first and second tables have a width that is less than the spacing between said first and second side panels, and said tables are disposed between said side panels, with clearance between said first and second tables and said side panels; and means for adjusting the vertical position of said first and second tables with respect to said base top panel, said adjustment means having a lowermost position wherein both said first and second tables are substantially at, or lower than, the top of said first side panel.

7. An assembly as recited in claim 6 wherein said second side panel is of essentially the same dimensions as said first side panel, and is ground-supported.

8. An assembly as recited in claim 6 wherein said means for adjusting the vertical positions of said first and second tables comprise power means; and a first support connecting said first table to said base, said first support comprising a tube that is quadrate in cross-section, and a bushing mounted to said base and for receipt of said tube for reciprocation with respect to said base; and wherein said power means comprises: a motor; a vertically extending lead screw operatively connected to said motor, said lead screw extending into the interior of said support tube; a nut disposed interiorly of said support tube and in screw-threaded engagement with said lead screw; and means for mounting said nut so that it is stationary with respect to said support tube.

9. An assembly as recited in claim 8 wherein said means for mounting said nut comprise a pair of fasteners extending through opposite sides of said tube and into abutting engagement with said nut; and means for adjusting the positions of said fasteners with respect to said tube so that the position of said nut within said tube may be adjusted, said nut having exterior cross-sectional dimensions substantially less than the interior cross-sectional dimensions of said support tube.

10. An assembly as recited in claim 9 further comprising a second support connecting said second table to said base, and wherein said second support and second power means are substantially identical to said first support and first power means.

11. A table assembly comprising:

a first table;

a base;

a support tube quadrate in cross-section and operatively attached to said first table;

adjustable bushing means attached to said base surrounding said support tube for positively guiding vertical linear reciprocation of said support tube with respect to said base; and power means for effecting vertical reciprocation of said support tube, and said first table connected thereto, with respect to said base, said power means comprising: a vertical extending lead screw; a motor operatively attached to said lead screw for effecting rotation thereof; an interiorly threaded nut operatively engaging said lead screw, said nut having exterior cross-sectional dimensions significantly less than the interior cross-sectional dimensions of said support tube, and extending into said support tube with a vertical orientation; and means for rigidly attaching said nut to said support tube so that the position of said nut within said support tube may be adjusted to insure alignment of said nut with said lead screw, but said nut is held stationary with respect to said support tube.

12. An assembly as recited in claim 11 wherein said means for mounting said nut comprise a pair of fasteners extending through opposite sides of said tube and into abutting engagement with said nut; and means for adjusting the positions of said fasteners with respect to said tube so that the position of said nut within said tube may be adjusted.

13. A table assembly comprising a first table; a second table; a base; a first support for interconnecting said base and said first table; a second support, distinct from said first support, for connecting said second table to said base; and adjustment means, associated with said second table and said second support, for providing adjustment of the angular orientation of said second table with respect to the horizontal, said adjustment means comprising: a generally horizontally extending arm portion of said second support; means for pivotally mounting said second table to said arm portion at a first position thereof, for pivotal movement about a horizontal axis; a generally vertically extending screw-threaded rod in screw-threaded engagement with said second support, said rod engaging said second support at a position horizontally spaced from said first position; and an adjustment wheel rigidly mounted to said screw-threaded rod for effecting rotation of said screw-threaded rod.

14. An assembly is recited in claim 13 wherein said rod terminates at an upper end thereof in a rounded tip which abuts, but is not connected to, the bottom of said second table.

15. A table assembly comprising:

a first table;

a second table;

a base;

a first support for interconnecting said base and said first table;

a second support, distinct from said first support, for connecting said second table to said base;

first power means, connected to said base, for adjusting the vertical position of said first table with respect to said base;

second power means, connected to said base, for adjusting the vertical position of said second table with respect to said base;

adjustment means, associated with said second table and said second support, for providing adjustment of the angular orientation of said second table with respect to the horizontal;

wherein said first support comprises a single support post extending upwardly from said base and operatively interconnected to said first table; and wherein said second support comprises a single support post extending upwardly from said base and operatively connected to said second table;

adjustment means for providing adjustment of the horizontal spacing of said first table with respect to said second table; and wherein said means for adjusting the spacing of said first table with respect to said second table comprises: a first bracket attached to said first support and having a generally horizontally extending surface; means defining a vertically through-extending opening in said first bracket horizontal surface; means operatively defining a plurality of horizontally spaced openings in the bottom of said first table; slide means mounted on said first table and said first support for allowing horizontal linear relative movement therebetween; and spring pressed plunger means passing through said opening in said first bracket horizontal portion and releasably into operative association with said openings in said first table bottom.

* * * * *